US005470066A

United States Patent [19]

Soong

[11] Patent Number: 5,470,066

[45] Date of Patent: Nov. 28, 1995

[54] STRING FIXER IN SPORTS RACKET

[76] Inventor: Tsai C. Soong, 1839 Jackson Rd., Penfield, N.Y. 14526

[21] Appl. No.: 243,776

[22] Filed: May 17, 1994

Related U.S. Application Data

[63] Continuation-in-part of Ser. No. 191,027, Feb. 2, 1994, abandoned, which is a continuation-in-part of Ser. No. 91,656, Jul. 15, 1993, abandoned.

[51] Int. Cl.[6] ..... A63B 51/10

[52] U.S. Cl. ..... 273/73 D

[58] Field of Search ..... 273/73 R, 73 C, 273/73 D

[56] References Cited

U.S. PATENT DOCUMENTS

| | | | |
|---|---|---|---|
| 763,059 | 6/1904 | Hyde | 273/73 D |
| 1,682,199 | 8/1928 | Smilie | 273/73 D |
| 3,921,979 | 11/1975 | Dischinger | 273/73 D X |
| 4,078,796 | 3/1978 | Gibello | 273/73 D |
| 4,168,065 | 9/1979 | Goransson | 273/73 D |
| 4,368,886 | 1/1983 | Graf | 273/73 D |
| 4,863,168 | 9/1989 | Anderka et al. | 273/73 D |
| 4,913,430 | 4/1990 | Lichtenstein | 273/73 D |

FOREIGN PATENT DOCUMENTS

| | | | |
|---|---|---|---|
| 2633070 | 1/1978 | Germany | 273/73 D |
| 2642978 | 3/1978 | Germany | 273/73 D |
| 2642694 | 3/1978 | Germany | 273/73 D |
| 2646038 | 4/1978 | Germany | 273/73 D |
| 2922631 | 12/1980 | Germany | 273/73 D |
| 3143674 | 5/1983 | Germany | 273/73 D |

*Primary Examiner*—William E. Stoll
*Attorney, Agent, or Firm*—Bernard A. Chiama

[57] ABSTRACT

A conventional sports racket is disclosed as having interwoven string systems in its string network whose midplane coincides with the midplane of the frame of the racket, wherein strings of one system which are approximately parallel among themselves are meshing with strings of other systems in large oblique angles at respective string joints where one string in one string system crosses over a string of another system under axial tension force. The invention includes at least having one string fixer, installed in a string joint, having interlocking legs arranged to exert compressive force to the strings from either side of the string network towards the midplane, or other ring typed device based on the same principle, which reduces sliding between the contacting strings from the impact of the ball on the string network of the racket. Also, is a string fixer which does not contact the ball when it hits the joint.

1 Claim, 7 Drawing Sheets

STRING FIXER IN SPORTS RACKET

This application is a continuation-in-part of the application Ser. No. 08//191,027, filed Feb. 2, 1994, now abandoned, which in turn is a continuation-in-part of the application Ser. No. 08/091,656, filed Jul. 15, 1993, now abandoned.

BACKGROUND OF THE INVENTION

In sports racket such as tennis, squash, etc. where a string network is employed to bounce a ball, having approximately interwoven orthogonal string systems in which each string is weaved through the corresponding orthogonal strings in the other system either above or below in a sequential manner, a common problem which affects the life of the strings and also of performance is that at the contact point, called a joint, between the orthogonal strings the two strings will slide over each other when a ball strikes close to the joint in the network. This sliding phenomenon loosens the network, adversely affected control, and strings may break prematurely due to excessive wear.

To reduce the sliding between crossing strings at the joint, there is a kind of device called string fixture which is attached onto the two strings at the joint reducing relative sliding between the strings. However, current string fixtures available in the market are not effective. A typical current string fixture is a device made of relatively hard material, such as hard plastics. It is simply a thin piece with shallow grooves, one on either side, inserted between the two contacting strings at the joint. The contact pressure between the two interwoven strings at the joint holds the central piece in place. The groove supports the string. Such a device is used to reduce the rubbing of the two strings against each other, but can not prevent sliding motion. It has no means to fix the two strings against relative movement caused by the impact of the ball. So, it is really not a string positioning fixer.

DESCRIPTION OF THE PREFERRED EMBODIMENTS

Figure 1A:
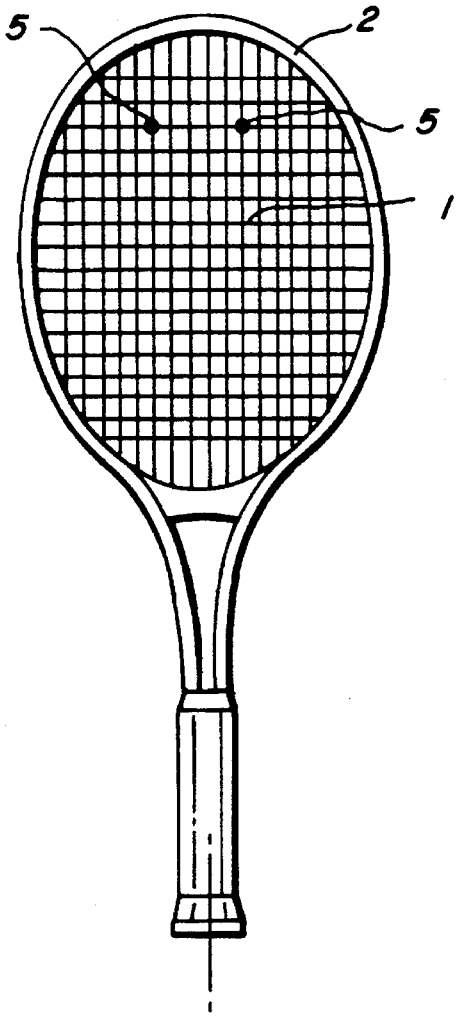
FIG. 1A shows a conventional sports racket, in particular, a tennis racket, and with the present invention applied.
Figure 1B:
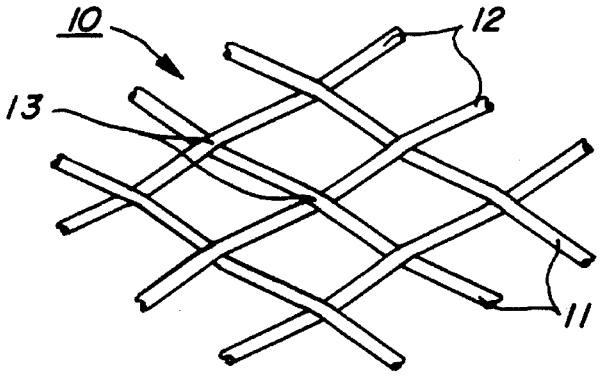
FIG. 1B shows a string joint in the string network of a racket.

A conventional sports racket as shown in FIG. 1A, having a string network 1 bounded and supported by a frame 2, comprising at least two string systems in which strings in the same system are approximately parallel to each other and interweaving with the strings of another system. For most rackets, there are only two string systems which are approximately perpendicular to each other and interwoven strings are approximately perpendicular to each other. FIG. 1B shows a typical region 10 in the string network 1 of the racket where 11 are parallel strings in one system and 12 are parallel strings in another system which are approximately perpendicular to each other. String joints 13 are formed where 11 interweaves with 12 and it is always one above or below the other and bends slightly at crossing point due to tension force in the strings. A string fixer, generally indicated by the numeral 5 as in FIG. 1A, may be installed in a string joint to prevent strings from sliding upon each other when a ball strikes the string network close to the joint. One or more string fixers may be installed at suitable string joints arbitrary. Locations and numbers depend on player's judgment.

Improved string fixers according to the invention comprising locking elements embracing tightly both strings at the string joint. A preferred design of a string fixer having at least two conjugate components, each having a base unit and an arm device extending across the midplane of the string joint to self lock onto a receptacle on the opposite conjugate component. It is called self locking because the design is such that once an arm device is eased into the receptacle, it is positively locked in position and can not back out again.

Figure 2A:
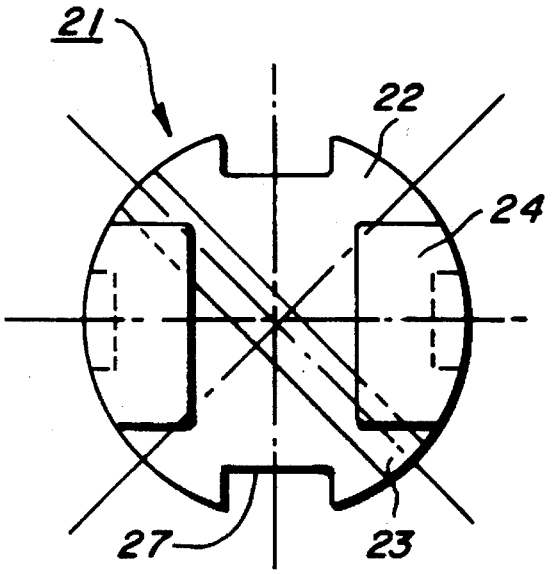
FIGS. 2A, 2B, 2C show an embodiment of a conjugate component of a string fixer of the invention.
Figure 2B:
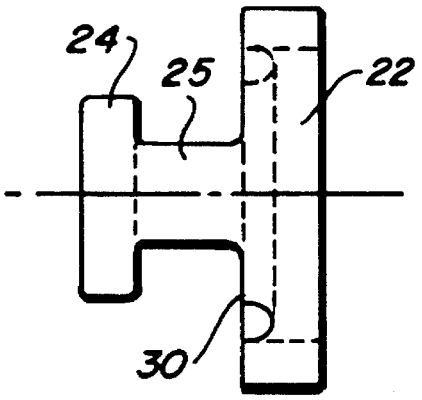
Figure 2C:
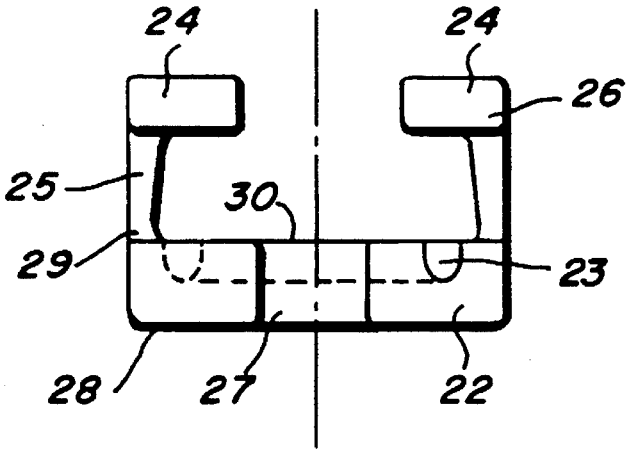

FIG. 2A, 2B and 2C show a preferred embodiment of a conjugate component of a string fixer 5. FIG. 2A shows a top view which is the view as looking down along a line perpendicular to the plane of the string network after the string fixer is installed. For this embodiment, the string fixer has two conjugate components which are identical. The conjugate component 21 comprises a base unit 22 which may have a shallow slot 23 to accommodate a string, and a leg unit 24 which has a leg 25 extending across the midplane of the string network and a holder 26 which is used to lock into the receptacle slot in the base unit of the opposite conjugate component. There should be a similar receptacle slot made in the base unit 22 along the surface 28 of the embodiment 21 but this is not shown for clarity. The side recess 27 is to accommodate a similar arm of the opposite conjugate component. There may be a thin neck 29 in 25 so that the arm can bend sidewise to accommodate the base unit of the opposite conjugate component during assembly. It is important that the device may have a cushion layer, not shown here, placed on the surface 30, so that this layer will be compressed by the strings in the string joint after assembly. The compression will create the necessary force to insure that the arm unit 24 will be tight and the two strings in the joint will be held tightly by the string fixer. Said cushion layer may be adhesively attached to the surface 30 of the conjugate component, or be separate pieces inserted on both sides of the string joint during assembly. That the two conjugate components can hold each other tightly after assembly with the bulky string joint inside is due to the self locking mechanism from the extending leg units 24. There could be numerous other ways to design the self locking mechanism. For example, slots may be provided in the base unit of the opposite conjugate component to receive the holder 26 from the first conjugate component so that it cannot slip out once it is has been eased into .the slot. In most cases, though not necessary, the two conjugate components may be identical. FIGS. 2B and 2C are side view and front view of the top view 2A.

Figure 3A:
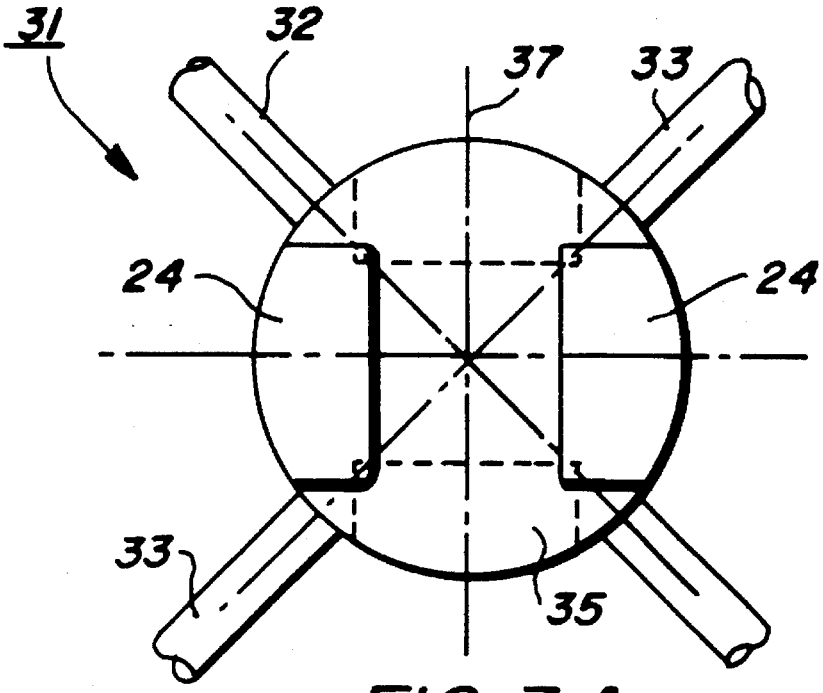
FIGS. 3A, 3B show a preferred embodiment of a string fixer.
Figure 3B:
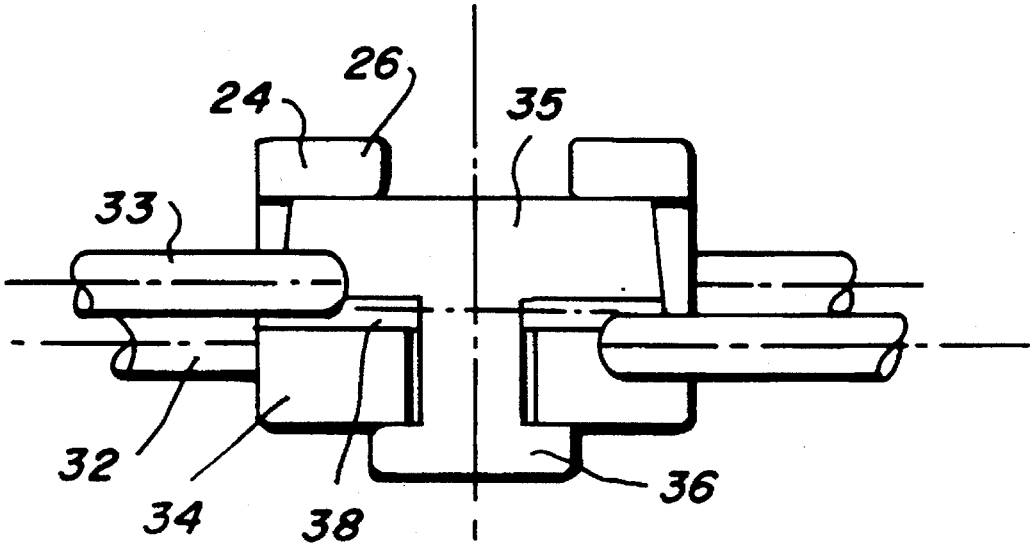

FIGS. 3A and 3B show the top view and the front view of a string fixer 31 installed over a string joint having cross over strings 32 and 33 whose midplane separates the lower conjugate component 34 (which is 22 of FIG. 2C) and the upper conjugate component 35. It is seen that the holders 26 of 34 locked over the base unit of 35 with the string joint enclosed in between. Also, holders 36 of the upper component 35 lock over the base unit 34 of the lower component in an exactly similar manner with a phase difference of 90 degrees in rotation. Note that in this embodiment, the two leg units 24 which contain 26 are symmetrical with respect to the plane 37 which bisects the angle made by the two strings. A part of the cushion layer 38 is shown.

Figure 4A:
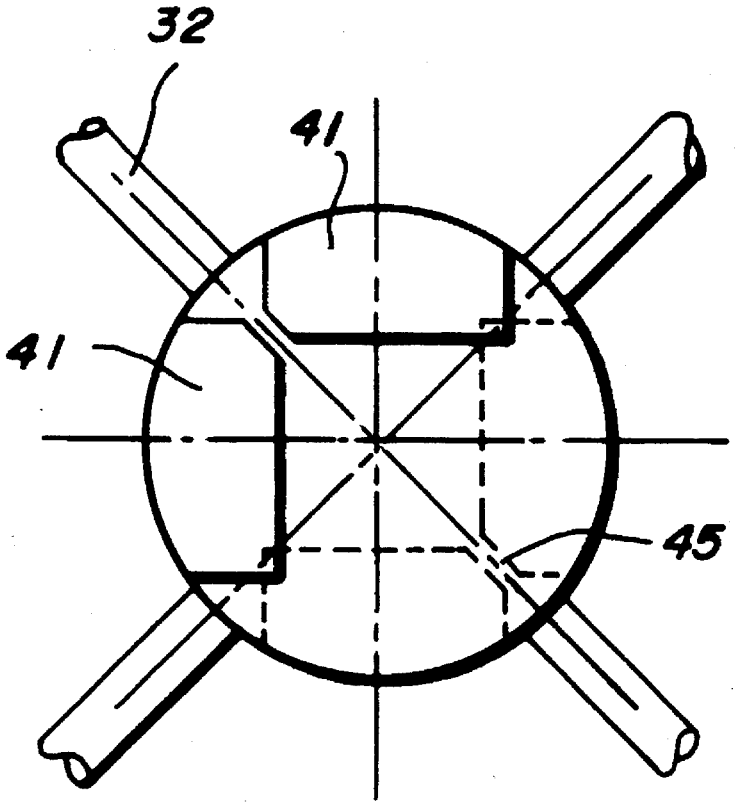
FIGS. 4A, 4B show yet another preferred embodiment of a string fixer.
Figure 4B:
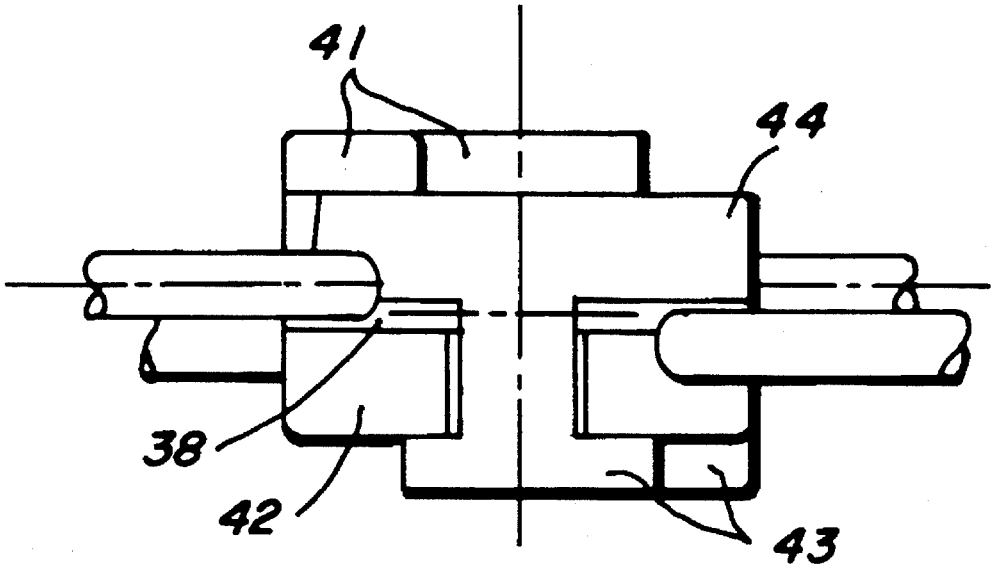

FIGS. 4A and 4B show views similar to FIGS. 3A and 3B but with a unique difference in that: in FIGS. 4A and 4B, the legs 41 from the lower component 42 and the legs 43 of the upper component 44 are symmetric to the plane 45 perpendicular to the string network plane and containing string 32. The merit of the latter arrangement is that of a better self locking balance of the conjugate components. When two identical conjugate components are self locked on to each other, one should pull the other equally towards the midplane by their extending leg units which are in tension force due to the compressed cushion layer enclosed in between them. In FIG. 3A device, any one of the two pairs of the oppositely placed legs from the conjugate components is sufficient to hold the string joint tightly. The locking action of the legs from the other conjugate component is redundant. In the FIG. 4 arrangement, both conjugate components share equally the balancing force required to hold the string joint.

The material of the conjugate component may be plastic, hard rubber compounds, or even metal. Then a cushion layer associated with the component is essential to maintain sufficient compression between conjugate components in the string fixer. One advantage of the concept of having two opposing conjugate components extending away from the midplane of the string network is to be able to provide a suitable surface shape on the exposing surface, such as a sharp pointing angle, so that the string fixer is able to bite into the contacting surface of the ball upon hit, adding spinning power to the ball.

Figure 7:
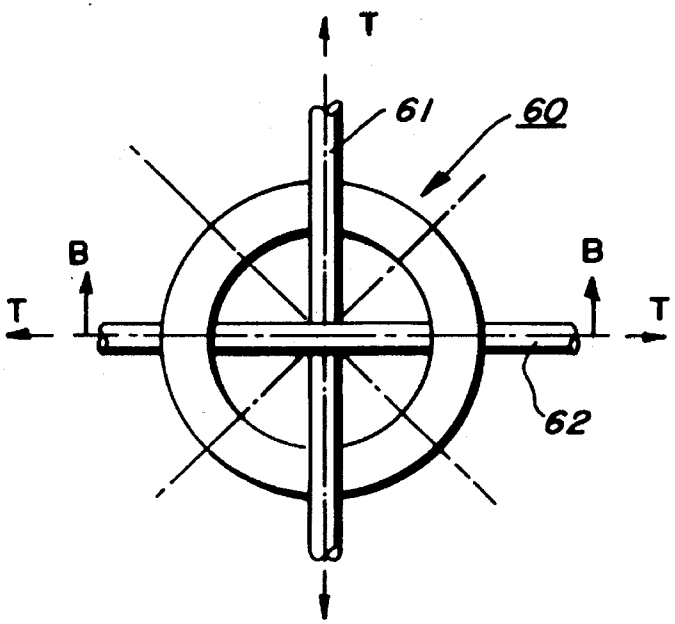
FIG. 7 shows another preferred, ring shaped embodiment.
Figure 8:
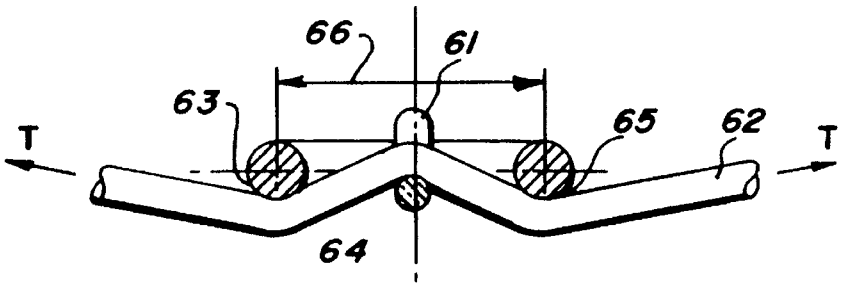
FIG. 8 shows the B—B cross section of FIG. 7.
Figure 5:
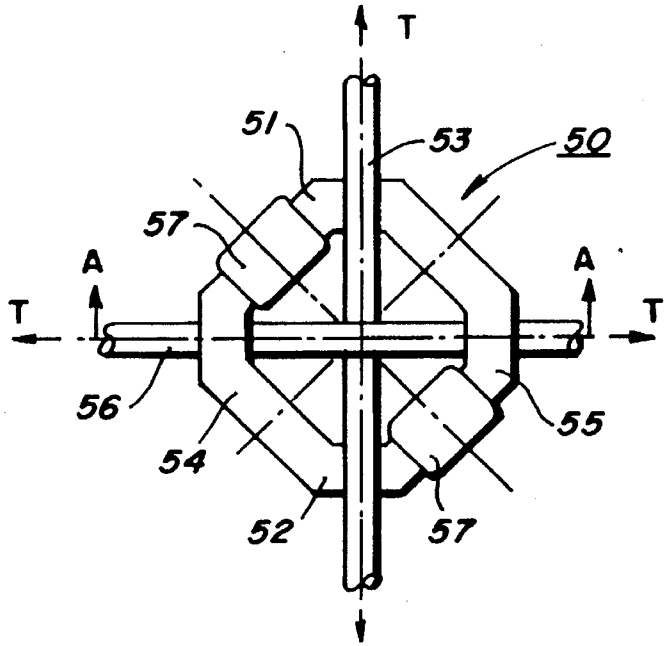
FIG. 5 shows a preferred, ring shaped embodiment.
Figure 6:
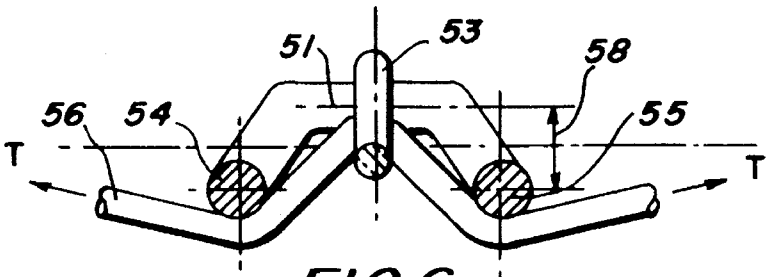
FIG. 6 shows the A—A cross section of FIG. 5.

Another type of preferred embodiments are shown in FIGS. 5, with cross section A—A shown in FIG. 6, and FIG. 7, with cross section B—B shown in FIG. 8, which is characterized by the fact that the fixer comprises essentially a ring device, having multiple structural segments encircling said string joint, whose main function is to bend the string at a distance from the joint, wherein each of the two approximately perpendicular strings crossed over at the joint is bent sharply by two opposite segments disposed across the string joint in the plane containing the string and perpendicular to the plane of the string network. The contact forces acting on the ring device then form two equal and opposite pairs of coplanar forces, maintaining force equilibrium of the ring device, one in each of said approximately perpendicular planes.

In the version shown in FIG. 5, the fixer 50 does not possess a common base plate connecting the ring segment 51 directly to 52 supporting the string 53. The two contact forces should form a coplanar force pair which bend the string in the plane perpendicular to the plane of the string network. Similarly, the opposing segments 54 and 55 whose support with the other string 56 forms a similar but oppositely directed force pair acting in the plane containing the string 56 and perpendicular to the string network. The ring device is in equilibrium. Detail may vary how the four segments are to be interconnected. FIG. 5 shows they form a continuous ring comprising two pieces, joined at their ends by a locking device 57, not shown in FIG. 6, which may be simple cap and screws, or other mechanical means. But other arrangement is possible. For example, may be only one locking device 57 is used instead of two, or the two halves may have ends extending into the receptacle of the other and fastened. The locking device may be one of the segment under a string. In such arrangement, there should be a groove in the center of 57 to position the segment under the string. This segment may be hollow and it can slide on the adjacent segments which enter the hollow from both ends of this segment. When this segment is moved off its central position, an opening of the otherwise continuous ring is uncovered and the assembly can slide into the string joint in other arrangement, the opposing segments may have diametrical structural arm linking them together. In the arrangement as FIG. 5 wherein the locking device 57 may be taken off and put on, the fixer 50 may be adapted to a string joint of a frame with existing string network. The normal contact force between the two strings is proportional to the string tension T and is influenced by the distance of the opposing segments and the height difference 58 of the two center planes of the segments.

The locking device 57 may be eliminated and the four segments are joined together to become one continuous endless ring, either as a polygon or as a circular ring. FIG. 7 shows such a simple ring type fixer 60 with the height 58 eliminated. In general, the plane form of 60 may be circular, oval, or polygonal, the cross section of the ring segment may be solid or hollow, round, oval, in the shape of a plate or other geometrical forms. The material may be plastic, synthetic, hard rubber, fiber-reinforced composite, or metal. In assembly, one string, say the 61, may be already strung on the frame. The ring 60 may then be placed under it or above it ready to be joined. Next, the cross string 62 should be threaded either under the ring, or above the ring, according to how 60 is placed with respect to 61. FIG. 7 shows how the two strings and the ring are to be weaved correctly, one above the other periodically. After 62 is through and pulled tight, the friction created in the four contact points between the two strings and the four segments will make the strings difficult to slide, reduce wear of the string, when the ball hits the string network. For example, if the string 62 is to slide axially at the joint, it has to overcome the frictions created at points 63, 64 and 65. The frictions would be significant if the tension T is large and the distance 66 between the segments is small. FIG. 7 embodiment is a very simple and effective fixer device, but the drawback is its installation to the frame have to be made during the time when the frame is being strung, not after the string network has been completed, like the others.

However, if the ring device, such as 60, is rigid enough or the opposite segments having direct support with each other, at least one slit opening across the thickness may be made between adjacent segments to let the interweaving string 62 to slip into the interior of the ring during installation and each string is properly supported by two opposite segments. Then the fixer with such a cut can be adapted to a completed string network just like the other embodiments. The difference between this continuous ring with a slit opening is that the opening has no slide-over cover as FIG. 5 embodiment. If the ring 60 is made of suitable metal or other hard, tough material, the gap of the slit may be closed by a hand tool, after the string is admitted into the interior. Accompanying drawings in these details are omitted due to the simplicity of the changes suggested.

The fixer as shown in FIG. 7 with or without the slit opening could be a very effective device as intended. It is very light in weight and its simplicity and effectiveness is breathtaking. Even though FIGS. 5 and 7 show a simple ring of continuous segments with a solid circular cross section, it could have periodic waviness in its circumferential contour encircling the string joint, or diametrical supportive arms reinforcing opposite segments across the joint, or the cross section of segments may be varied to hold the string for fitness. Material of embodiments 50 and 60 may be tough and resilient, such as polyurethan, can be bent but keeping its required shape without hurting the string.

It is to be noted that protruding element, such as raised ridges with sharp edges, of the same material, or of a different material adapted to the ring device, extending outwardly from the outer surface of the segment whose inner surface is pressing against the string, is made as an integral part of the ring device, so that when the ball impacts the segment, the increased pressure to the segment, and therefore the increased friction in the interface of the string and the segment created from the impact, will keep the segment and the corresponding string in a tighter fit in its adaptation, and thereby improves the performance of the fixer.

Also, the fixer maybe a stand-alone equipment to be adapted to an existing sports racket.

String Fixer Which Does Not Expose Itself in Contact With the Ball

In all the embodiments described in previous paragraphs, at least a part of the fixer will be in contact with the ball when the ball hits the string joint. For official competitions, a string fixture installed in a tennis racket should be so constructed and positioned that no part of the fixer will be in surface contact with the ball during play.

Figure 9:
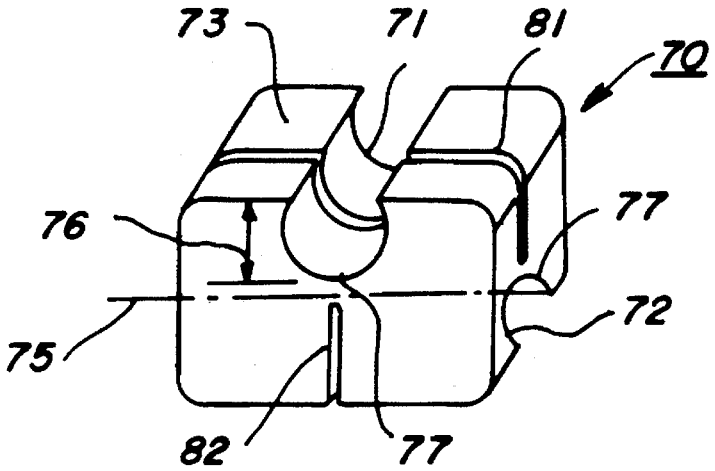
FIG. 9 shows another preferred embodiment.
Figure 10:
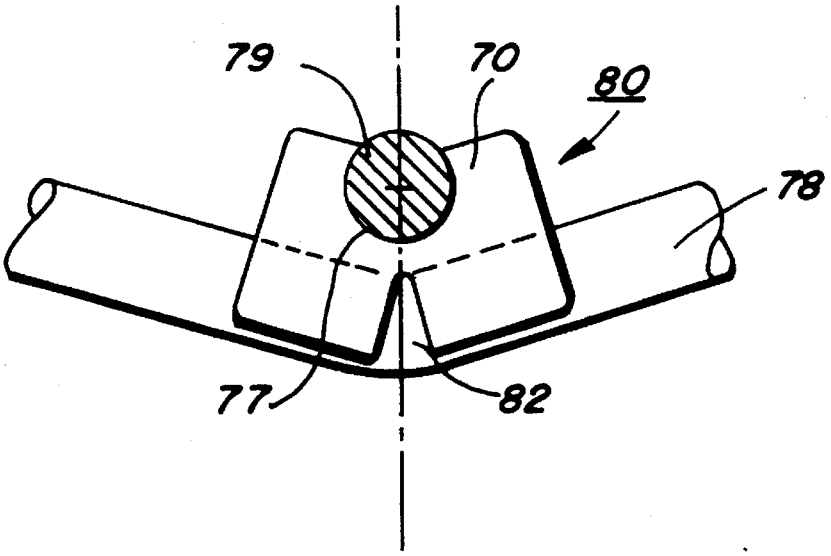
FIG. 10 shows a string bends the string fixer at the string joint.

FIG. 9 shows an embodiment of a string fixer which does not expose itself beyond the outermost boundary of a string in the string joint in the direction away from the midplane of the string network. The fixer 70 is made of plastics, such as polyglass, Nylon, polyurethan and other stiff, tough and deformable materials, easy to be molded or machined. It may be approximately rectangular, cylindrical or other geometrical shapes in plain form with suitable thickness with rounded edges and cutouts to save weight. It is featured by having two approximately perpendicular slots 71 and 72 on the two parallel sides 73 and 74 respectively, distant from the middle plane 75 of the solid which coincides with the midplane of the string network when the string fixer is installed. The two approximately perpendicular slots will accommodate the two strings joined at the string joint 80 shown in FIG. 10 respectively. Each side 73 and 74 is associated with respective wall pieces which hold the string. The slot may not be straight in the direction of the string it accommodates. The axis of the slot may be inclined to the axis of the string in such a way that when the string is bent when joined by the other string in the perpendicular direction, the clamping compressive force on the string from the walls of the slot can be greater than if the axis of the slot is parallel to the axis of the string before the installation. The diameter of the slot should be smaller than the diameter of the string so that the string can be held tightly by friction caused by the pressure from the side walls 77 of the slot. At least a small, top part of the string farthest from the midplane of the string network should be exposed from the slot so that when the ball hits the string, it is not in contact with any surface of the string fixer. This means the height 76 should be less than the diameter of the string the slot holds. For performance sake, on the other hand, 76 should be greater than the radius of the string 79 so that the string can be held very tight when the perpendicular string 78 is bent at the string joint 80 which forces the wall 77 to press tightly against the string 79. The installed strings at the joint is shown in FIG. 10. Of course, the other string, string 78, is also clamped hard at its own slot and the pressure from the wall of that slot is similarly enhanced by the bent from the upper string 79.

When the material of the string fixer is soft, the strings may be held tightly by the friction thus created. But if the material is relatively hard and the bending angle at the joint is small, means is needed to reduce the bending rigidity of the body 70. One way is to have narrow cuts as 81 and 82 made in the body, at least one cut made for each side of the body, as shown in FIG. 9. This cut, partially or extending to the full width, will reduce the bending rigidity of the body in the direction the string is bending the fixer's body as shown in FIG. 10.

Figure 11:
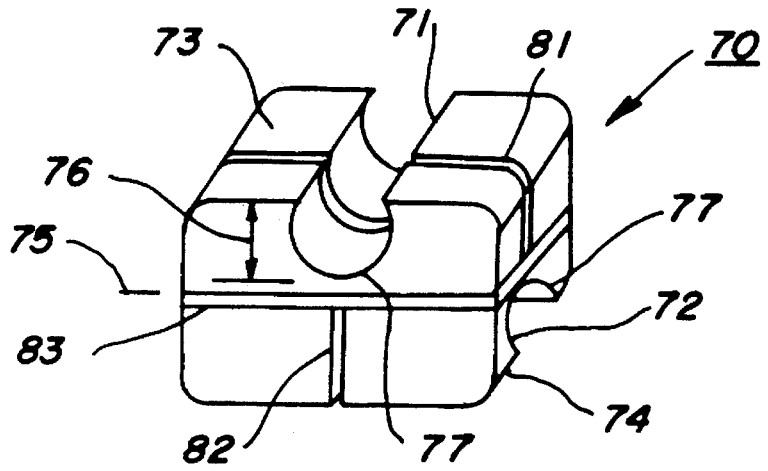
FIG. 11 shows another preferred embodiment with a sheet in the midplane.
Figure 12:
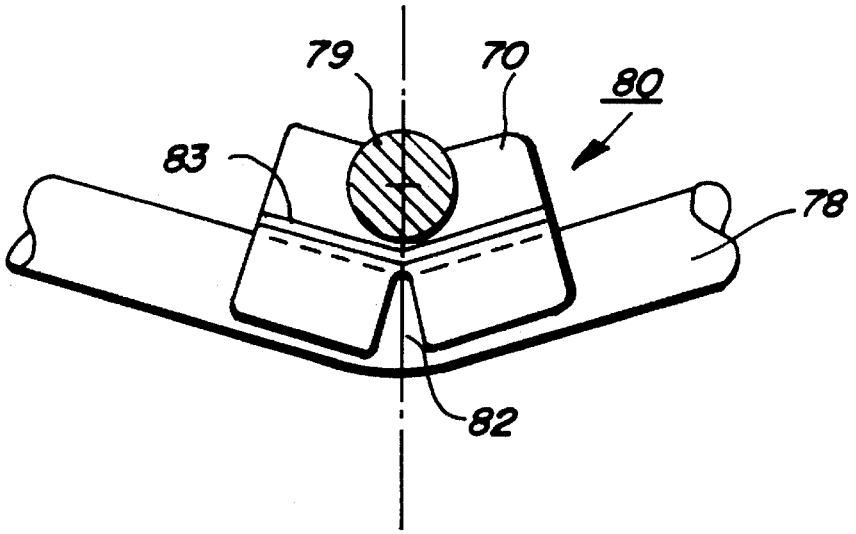
FIG. 12 shows the string fixer of FIG. 11 installed at a string joint.

FIGS. 11 and 12 show another preferred embodiment in which there is a thin sheet 83, hard but flexible material, metal or plastic, at the midplane of the device. On both sides of the sheet, elastic and deformable wall piece are rigidly attached. The construction is approximately the same as shown in FIG. 9 except there is this thin piece at the midplane of the body. This thin piece helps to put uniform pressure on the wall from the bending of the body by the string.

To take advantage of the compressive force from the bending of the interwoven strings at the string joint to hold the two strings tightly against relative motion between each other, but without exposing the string fixer to the ball, and the necessary accompanying means to achieve that purpose effectively, are the features of this embodiment of the invention.

That is claimed is:

1. In a sports racket having a frame with a midplane passing the neutral plane of the cross section of the frame, and a string network having interwoven string systems whose midplanes coincides with the midplane of the frame, wherein strings of one system which are approximately parallel among themselves are meshing with the strings of at least one other system in large oblique angles at respective string joints where strings in one system cross over strings of another system, interwoven with each other at the string joint, the improvement comprising a string fixer installed in at least one of the string joints, pressed in between the two interwoven strings, holding the two strings in place, said string fixer including holding means arranged to exert clamping compressive force to hold the strings from slipping in the direction of their respective axes, said holding means being formed with a slot for holding a string on either side of the midplane of the string fixer, said holding means having further means for reducing the bending rigidity of the string fixer and thereby effecting bending thereof by the interwoven strings and thereby increasing the clamping force for holding the strings from slipping in the direction of their respective axes as aforesaid, and wherein said further means is a cut through the thickness of said string fixer, at least one on either side thereof which reduces the bending rigidity of said string fixer making it easier for bending by the interwoven strings.

* * * * *